US009636909B2

(12) United States Patent
Yamamoto

(10) Patent No.: US 9,636,909 B2
(45) **Date of Patent: *May 2, 2017**

(54) DRIVING DEVICE FOR DRIVING PIEZOELECTRIC ELEMENT

(71) Applicant: SEIKO EPSON CORPORATION, Tokyo (JP)

(72) Inventor: Toshiyuki Yamamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/953,880

(22) Filed: Nov. 30, 2015

(65) Prior Publication Data

US 2016/0075131 A1 Mar. 17, 2016

Related U.S. Application Data

(63) Continuation of application No. 14/529,927, filed on Oct. 31, 2014, now Pat. No. 9,227,397, which is a (Continued)

(30) Foreign Application Priority Data

Mar. 12, 2013 (JP) ..... 2013-048836

(51) Int. Cl.
*B41J 2/045* (2006.01)

(52) U.S. Cl.
CPC ..... *B41J 2/04541* (2013.01); *B41J 2/04536* (2013.01); *B41J 2/04581* (2013.01); *B41J 2/04586* (2013.01); *B41J 2/04588* (2013.01)

(58) Field of Classification Search
CPC B41J 2/04536; B41J 2/04541; B41J 2/04581; B41J 2/04586; B41J 2/04588
See application file for complete search history.

(56) References Cited

U.S. PATENT DOCUMENTS 9,010,894 B2 * 4/2015 Yamamoto ..... B41J 2/04541 347/10
9,227,397 B2 * 1/2016 Yamamoto ..... B41J 2/04541
(Continued)

FOREIGN PATENT DOCUMENTS

JP 10-138473 A 5/1998
JP 2010-120328 A 6/2010
(Continued)

*Primary Examiner* — Alessandro Amari
*Assistant Examiner* — Roger W Pisha, II
(74) *Attorney, Agent, or Firm* — Global IP Counselors, LLP

(57) ABSTRACT

A liquid ejection device includes a head unit and a control unit. A driving signal generating portion of the control unit is configured to create a driving signal having at least one wave portion for ejecting the liquid from the nozzles. A signal converting portion of the control unit is configured to convert plural types of original control signals including an original latching signal and an original printing data signal into a single serial control signal having a serial form. A signal restoring portion of the head unit is configured to create plural types of restored control signals from the serial control signal received, the restored control signals including a restored latching signal and a restored printing data signal. The nozzles are configured and arranged to eject the liquid based on the driving signal, the restored latching signal, and the restored printing data signal.

8 Claims, 3 Drawing Sheets

Related U.S. Application Data continuation of application No. 14/156,763, filed on Jan. 16, 2014, now Pat. No. 9,010,894.

(56) References Cited

U.S. PATENT DOCUMENTS

| | | | | |
|---|---|---|---|---|
| 2005/0190218 | A1 | 9/2005 | Usui | |
| 2007/0211092 | A1 | 9/2007 | Shingyohuchi et al. | |
| 2007/0279449 | A1 | 12/2007 | Mori et al. | |
| 2009/0147034 | A1 | 6/2009 | Yoshida | |
| 2009/0189936 | A1 | 7/2009 | Tamura | |
| 2009/0244135 | A1 | 10/2009 | Kaieda et al. | |
| 2010/0245425 | A1 | 9/2010 | Suzuki | |
| 2011/0122002 | A1 | 5/2011 | Tsunoda | |
| 2012/0086755 | A1 | 4/2012 | Sayama | |
| 2012/0236053 | A1 | 9/2012 | Tamura | |
| 2014/0267479 | A1 | 9/2014 | Yamamoto | |
| 2015/0062215 | A1* | 3/2015 | Shirato | B41J 2/04541 347/9 |

FOREIGN PATENT DOCUMENTS

| | | | |
|---|---|---|---|
| JP | 2010-208219 | A | 9/2010 |
| JP | 2011-109555 | A | 6/2011 |

* cited by examiner

DRIVING DEVICE FOR DRIVING PIEZOELECTRIC ELEMENT

CROSS-REFERENCE TO RELATED APPLICATIONS

This application is a continuation application of U.S. patent application Ser. No. 14/529,927, filed on Oct. 31, 2014, which is a continuation application of U.S. patent application Ser. No. 14/156,763 filed on Jan. 16, 2014, now U.S. Pat. No. 9,010,894. This application claims priority to Japanese Patent Application No. 2013-048836 filed on Mar. 12, 2013. The entire disclosures of U.S. patent application Ser. Nos. 14/529,927 and 14/156,763 and Japanese Patent Application No. 2013-048836 are hereby incorporated herein by reference.

BACKGROUND

Technical Field

The present invention relates to a liquid ejection device and a liquid ejection method.

Related Art

As a liquid ejection device, a printing device is known, in which a plurality of nozzle units each including a nozzle for ejecting liquid are provided at a single head unit (see, Japanese Unexamined Laid-open Patent Application Publication No. 2010-120328). There is a tendency that the number of nozzles provided at a single head unit or the number of nozzle units increase in accordance with an increasing data amount (enhanced image quality) of an image to be printed. In a printing device, various kinds of signals for driving a nozzle are created by a main controller (control unit) and transmitted to respective nozzle units of the head unit. For this reason, the increased number of nozzles and nozzle units results in increased signals, which in turn causes increased wirings (signal lines) which connect a control unit for creating signals and a head unit provided with nozzle units and transmits a signal.

SUMMARY

To solve these problems, for example, signals used in respective nozzle units can be communized to reduce signals. However, it is difficult to simply communize signals because of the position of nozzle units attached to a head unit and individual differences of the nozzle units.

Also, for example, as described in Unexamined Laid-open Patent Application Publication No. 2010-120328, it can be conceivable to decrease wirings (signal lines) connecting a control unit and a head unit by converting a signal to be transmitted from the control unit to the head unit into serial data using a SerDes (seriarizer/deserializer) circuit. However, in the technology described in Unexamined Laid-open Patent Application Publication No. 2010-120328, the head unit converts the serial data received from the control unit into parallel data and creates a driving signal for driving a nozzle. Therefore, there are problems that the structure of the head unit becomes complex, resulting in a large physical size. To simplify the structure of the head unit, it can be conceivable to create a driving signal at the control unit side and transmit to the head unit after converting into serial data along with other signals. However, when the driving signal is converted into serial data, there is a possibility that the wave is disturbed, causing an unstable ejection of ink from the nozzle.

Therefore, in a conventional printing device, it is desired to satisfy both of the control of the increase of signal lines between the control unit and the head unit and the stabilization of the ejection of ink. Also, in a conventional printing device, it is desired to simplify the structure, lower the cost, improve the performance is improved, etc.

The present invention was made to solve at least a part of the aforementioned problems, and can be actualized as the following aspects or applied examples.

According to one aspect of the present invention, a liquid ejection device includes a head unit and a control unit. The head unit includes a plurality of nozzle units each having a plurality of nozzles configured and arranged to eject liquid. The control unit is configured to control ejection of the liquid. The control unit includes a driving signal generating portion, a control signal generating portion, a signal converting portion, a driving signal transmitting portion, and a control signal transmitting portion. The driving signal generating portion is configured to create a driving signal having at least one wave portion for ejecting the liquid from the nozzles. The control signal generating portion is configured to create plural types of original control signals including an original latching signal for controlling a timing of the ejection of the liquid from the nozzles and an original printing data signal for controlling ejection or non-ejection of the liquid. The signal converting portion is configured to convert the plural types of the original control signals into a single serial control signal having a serial form. The driving signal transmitting portion is configured to transmit the driving signal to the head unit in an analog form. The control signal transmitting portion is configured to transmit the serial control signal to the head unit in the serial form. The head unit includes a driving signal receiving portion, a control signal receiving portion, and a signal restoring portion. The driving signal receiving portion is configured to receive the driving signal from the control unit. The control signal receiving portion is configured to receive the serial control signal from the control unit. The signal restoring portion is configured to create plural types of restored control signals to be input to the nozzle units from the serial control signal received, the restored control signals including a restored latching signal for controlling the timing of the ejection of the liquid from the nozzles and a restored printing data signal for controlling ejection or non-ejection of the liquid. The nozzles are configured and arranged to eject the liquid based on the driving signal, the restored latching signal, and the restored printing data signal. According to the liquid ejection device of this embodiment, a single serial form serial control signal is created from plural types of original control signals, which in turn is transmitted to the head unit. Therefore, the increase of wirings (signal lines) of the liquid ejection device can be controlled, thereby making it possible to simplify the structure of the device. Also, the driving signal is transmitted to the head unit in an analog form. Therefore, since the wave of the driving signal will not be disturbed due to the conversion into a serial form, an intended amount of liquid will be stably ejected from the nozzle. Further, since there is no delay for the driving signal due to the conversion into a serial form, the liquid is ejected from the nozzle at intended timings. Further, since it is not required to provide a circuit for creating, e.g., a driving signal on the head unit, the head unit can be made small.

Not all of the plurality of structural components of each of the aforementioned aspects of the present invention is required. To solve a part or all of the aforementioned problems, or to achieve a part or all of the effects described in this specification, parts of the structural element among the plurality of structural elements can be changed, eliminated, switched with other new structural element, and a limited content thereof can be partially eliminated. Also, to solve a part or all of the aforementioned problems, or to achieve a part or all of the effects described in this specification, a part or all of the technical characteristics included in the aspect of the present invention can be combined with a part or all of the technical characteristics included in other aspects of the present invention to form an independent embodiment of the present invention.

For example, an aspect of the present invention can be actualized as a device including one or more elements among a driving signal generating portion, a control signal generating portion, a signal converting portion, a driving signal transmitting portion, a control signal transmitting portion, a driving signal receiving portion, a control signal receiving portion, and a signal restoring portion. That is, the device can include a driving signal generating portion, but not required. Also, the device can include a control signal generating portion, but not required. Further, a signal converting portion can be included, but not required. Furthermore, a driving signal transmitting portion can be included, but not required. Also, a control signal transmitting portion can be included, but not required. Also, a driving signal receiving portion can be included, but not required. Further, a control signal receiving portion can be included, but not require. Also, a signal restoring portion can be included, but not required. The device can be actualized as a liquid ejection device, for example, and also can be actualized as another product other than a liquid ejection device. According to these aspects, at least one of various problems such as miniaturization of the product, cost reduction, resource-saving, simplification of production, improvement of usability, etc., can be solved. A part or all of the technical characteristics of the liquid ejection device can be applied to this product.

The present invention can be actualized in various forms other than a liquid ejection device. For example, it can be actualized in the form of a liquid ejection method, a method of producing a liquid ejection device, a control method of a liquid ejection device, a computer program to actualize the functions of these methods, devices, or systems, a recording medium for recording the computer program, etc.

BRIEF DESCRIPTION OF THE DRAWINGS

Referring now to the attached drawings which form a part of this original disclosure.

DETAILED DESCRIPTION OF EXEMPLARY EMBODIMENTS

A. Embodiment

Figure 1:
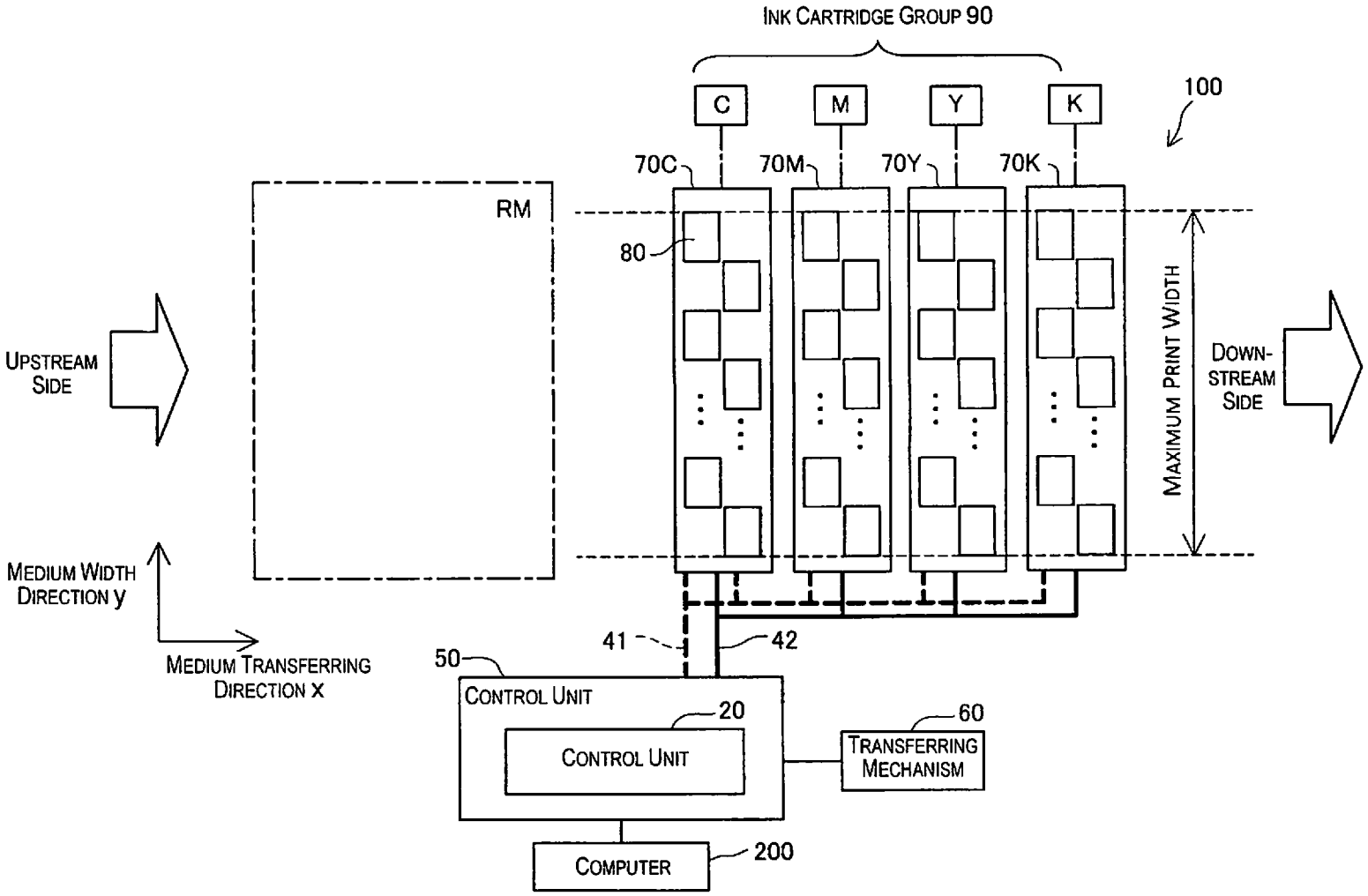
FIG. 1 is a figure showing a schematic structure of a printer as a liquid ejection device according to an embodiment of the present invention.

FIG. 1 is a figure showing a schematic structure of a printer 100 as a liquid ejection device according to an embodiment of the present invention. The printer 100 is a line head type printer, which forms ink dots on a print medium RM by ejecting ink as liquid according to image data supplied from a computer 200. The printer 100 is provided with an ink cartridge group 90, head units 70C, 70M, 70Y, 70K, a control unit 50, and a transferring mechanism 60. Hereinafter, the head units 70C, 70M, 70Y, and 70K will also be simply and collectively referred to as a head unit 70.

The ink cartridge group 90 is constituted by a plurality of ink cartridges accommodating respective inks of cyan C, magenta M, yellow Y, and black K. Each ink cartridge supplies ink to the head units 70 connected to each ink cartridge.

As shown in FIG. 1, the head unit 70 is provided with a plurality of nozzle units 80. The nozzle units 80 are arranged in a zigzag manner as shown in FIG. 1 with the intervals between adjacent nozzles constant along the maximum print width. The nozzle unit 80 includes a plurality of nozzles. The plurality of nozzles constitute a nozzle array arranged in a zigzag manner in a medium widthwise direction y intersecting with a transferring direction x of the print medium RM. The nozzle array ejects the ink accommodated in the ink cartridge connected to each head unit 70. The nozzle unit 80 includes a piezoelectric element inside of an ink path to the nozzle. The piezoelectric element controls an amount of ink drops to be ejected from each nozzle depending on a voltage to be input. In this way, the printer 100 of this embodiment is a so-called line head type inkjet printer which prints without main scanning of the nozzle unit 80. Also, the plurality of nozzles constituting each nozzle array is not required to be arranged in a zigzag manner along the nozzle array direction, and can be arranged linearly along the nozzle array direction. Further, the nozzle array direction is not always required to be in a direction perpendicular to the print medium RM as long as it is a direction intersecting with the transferring direction x of the print medium RM.

The transferring mechanism 60 is provided with a medium transferring motor (not illustrated) and a transferring belt (not illustrated). The medium transferring motor drives the transferring belt. The transferring belt transfers the print medium RM from the upstream side to the downstream side within the maximum print width of the head unit 70 by the drive of the medium transferring motor.

The control unit 50 is provided with a control unit 20 and an encoder (not illustrated). The encoder creates a signal showing a transferred amount of the print medium RM and inputs the created signals to the control unit 20. In the control unit 20, plural types of original control signals and a driving signal COM are created based on various types of data and signals obtained from the computer 200 by the control unit 50. The plural types of created original control signals are converted into a serial form and transmitted to the head unit 70 via the signal line 41. The signal line 41 is a difference transmission path for transmitting signals converted into a serial form. The signal line 42 is for transmitting an analog form signal. The details of signals to be created at the control unit 20 and the head unit 70 and to be transmitted will be explained later. In the printer 100, the nozzle unit 80, the medium transferring motor, and the transferring belt operate based on these signals, which executes a printing process to the print medium RM.

Figure 2:
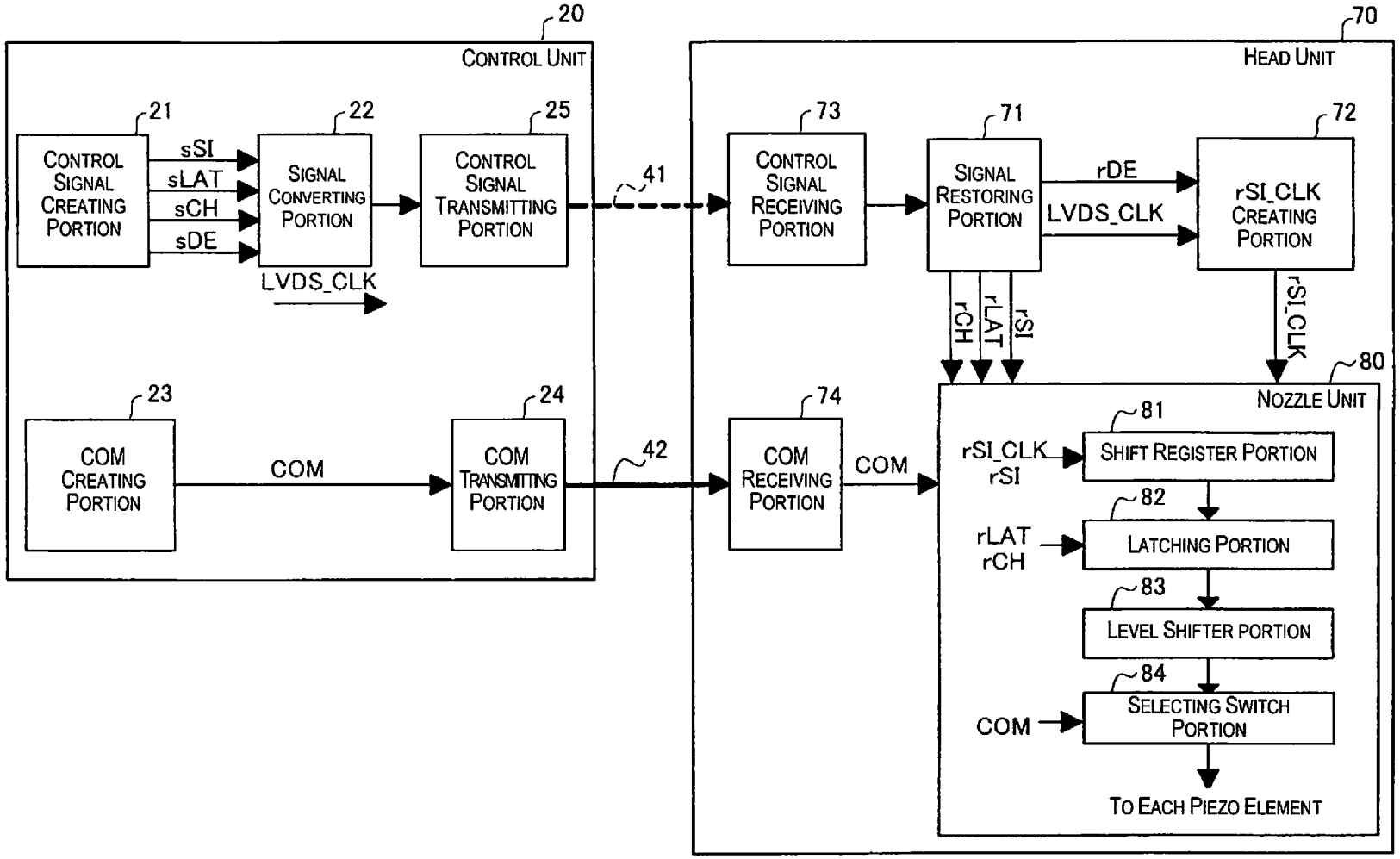
FIG. 2 is a figure showing a schematic structure focusing on a control unit and a head unit of a printer.

FIG. 2 is a figure showing a schematic structure focusing on the control unit 20 and the head unit 70 of the printer 100.

The control unit 20 is provided with a control signal generating portion 21, a signal converting portion 22, a control signal transmitting portion 25, a driving signal (COM) creating portion 23, and a COM transmitting portion 24. The head unit 70 is provide with a control signal receiving portion 73, a signal restoring portion 71, a clock signal (rSI_CLK) creating portion 72, a COM receiving portion 74, and a nozzle unit 80 having a plurality of nozzles. The head unit 70 includes a plurality of nozzle units 80, but FIG. 2 shows a single nozzle unit 80 for the convenience of explanation. The nozzle unit 80 is provided with a shift register portion 81, a latching portion 82, a level shifter portion 83, and a selecting switch portion 84. In this embodiment, the head units 70C, 70M, 70Y, and 70K each have the structure shown in FIG. 2 and separately receive signals from the control unit 20 via signal lines 41 and 42. Further, the control signal receiving portion 73, the signal restoring portion 71, and rSI_CLK generating portion 72 can be provided jointly as a single unit for all head units 70 or for each nozzle unit 80.

The control signal generating portion 21 of the control unit 20 creates plural types of original control signals including an original printing data signal sSI, an original latching signal sLAT, an original channel signal sCH, and an original data enable signal sDE, based on various types of data or signals obtained by the control unit 50 from the computer 200. The control signal generating portion 21 inputs these plural types of original control signals into a signal converting portion 22 in a parallel form. The signal converting portion 22 converts the plural types of low-speed original control signals (parallel data) into a serial control signal in a high-speed serial form. The signal converting portion 22 is also called a serializer. The serial control signal is transmitted to the head unit 70 by the control signal transmitting portion 25 via the signal line 41. Specifically, the signal converting portion 22 creates a clock signal (hereinafter referred to as clock signal LVDS_CLK for LVDS) used for high-speed serial data transmission called LVDS (Low Voltage Differential Signaling). The signal converting portion 22 creates a serial control signal by serializing the created clock signal LVDS_CLK for LVDS and plural types of original control signals input to the signal converting portion 22 in a parallel form. The serial control signals are transmitted to the head unit 70 by a LVDS transmitting method.

A COM creating portion 23 of the control unit 20 creates an analog form driving signal COM based on various types of data or signals obtained by the control unit 50 from the computer 200. The created driving signal COM is transmitted to the head unit 70 in an analog form by the COM transmitting portion 24 via the signal line 42.

A control signal receiving portion 73 of the head unit 70 receives the serial control signal via the signal line 41. A signal restoring portion 71 deserializes the received serial control signal and creates a restored control signal. The restored control signal includes a restored printing data signal rSI, a restored latching signal rLAT, a restored channel signal rCH, and a restored data enable signal rDE. A rSI_CLK generating portion 72 creates a clock signal rSI_CLK using the deserialized restored data enable signal rDE and the clock signal LVDS_CLK for LVDS. The clock signal rSI_CLK is a clock signal for the restored printing data signal rSI. The rSI_CLK generating portion 72 creates the clock signal rSI_CLK by dividing the clock signal LVDS_CLK for LVDS when the restored data enable signal rDE is at a high level. The restored printing data signal rSI, the restored latching signal rLAT, the restored channel signal rCH, and the created clock signal rSI_CLK are transmitted to the nozzle unit 80. The signal restoring portion 71 of the head unit 70 is also called a deserializer.

Figure 3:
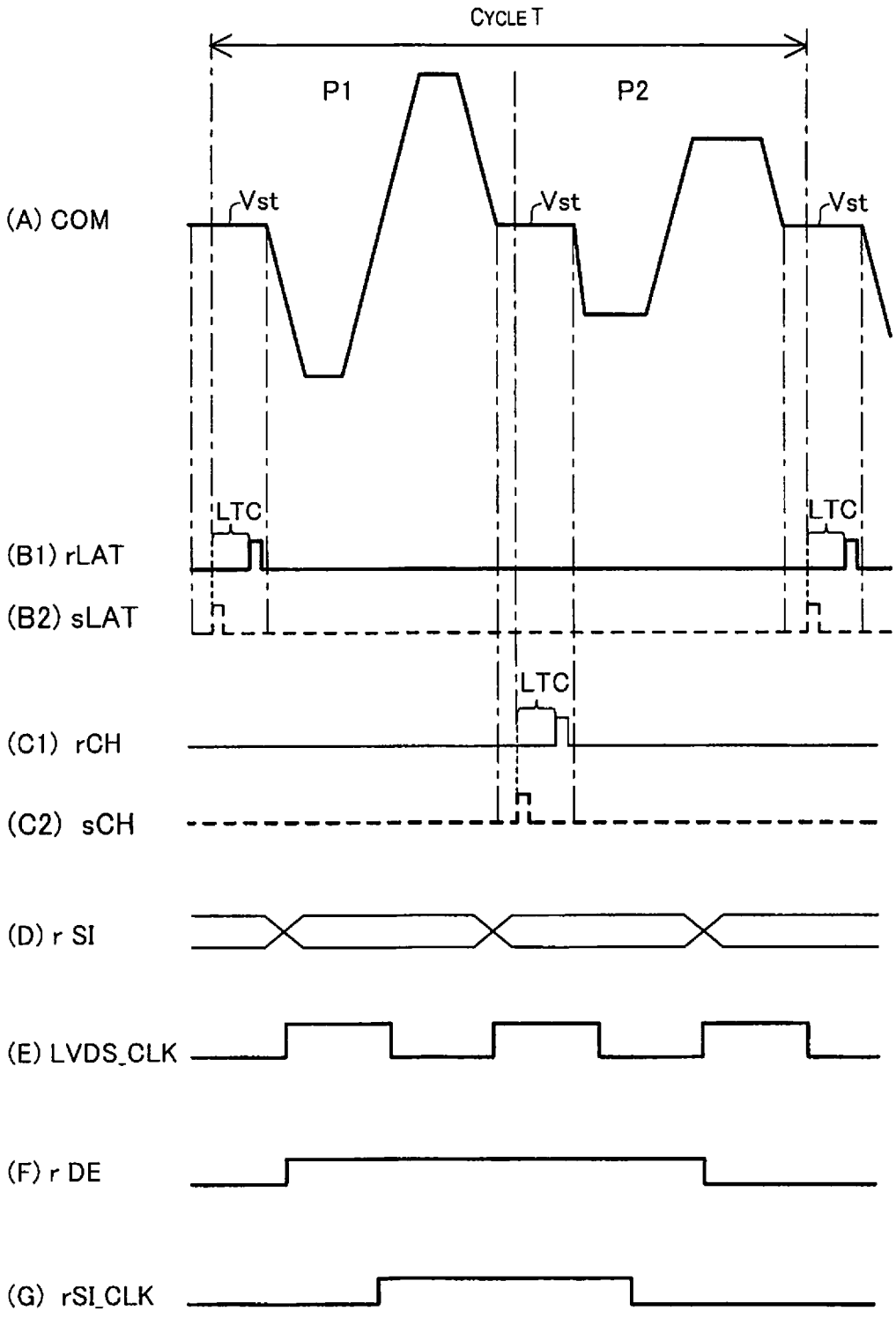
FIG. 3 is a figure showing an example of various types of signals to be input to a nozzle unit.

FIG. 3 is a figure showing an example of various types of signals input to the nozzle unit 80. In FIG. 3(A), an example of the driving signal COM is shown. The driving signal COM is an analog signal for driving a piezoelectric element for ejecting ink from the nozzle. The driving signal COM of this embodiment includes a wave portion P1 and a wave portion P2 in a cycle T of a pixel. The front potential of the cycle T of the driving signal COM (front potential of the wave portion P1) is held at a steady potential Vst. The front potential of the wave portion P2 is also held at a steady potential Vst. In this specification, the driving signal COM being held at a steady potential Vst means that the level of the driving signal COM essentially does not change (significantly) from that potential, although slight changes due to noise or error is allowed. The "wave portion" means a part of the driving signal COM and a part including the voltage changes.

The rising portion of each wave of the driving signal COM, for example, increases the capacity of the ink chamber communicated with the nozzle, and the falling portion decreases the capacity of the ink chamber to push the ink out of the nozzle. The portion of the driving signal COM held at a steady potential Vst does not increase or decrease the capacity of the ink chamber. The driving signal COM having such wave portions is input to the piezoelectric element, which in turn causes the ink to be ejected from the nozzle, thereby forming ink dots on the pixel position on the print medium RM. Further, the driving signal COM input to the piezoelectric element is determined by the restored printing data signal rSI which controls whether or not the ink is ejected from the nozzle. For example, when the restored printing data signal rSI shows a large dot, a driving signal COM including a combination of wave portions forming large dots is input to the piezoelectric element.

The period in which the front potential of the driving signal COM or the front potential of the wave portion P2 is held at a steady potential Vst is more than the total of a period needed for the plural types of original control signals to be converted into a serial form signal (serial control signal) and a period needed for the serial control signal to be deserialized to create the restored control signal. The period for holding the front potential of the driving signal COM or the front potential of the wave portion P2 at a steady potential Vs can be defined by the performance of the signal converting portion 22 and the signal restoring portion 71. Further, the period for holding at a steady potential Vst can be twice or more than twice the period needed for the plural types of the original control signal to be converted to a serial control signal. Furthermore, the period for holding at the steady potential Vst can be twice or more than twice the period needed to create the plural types of the restored control signal from the serial control signal.

The restored latching signal rLAT shown in FIG. 3(B1) is a signal for controlling the timing for ejecting the liquid from the nozzle and defining a cycle T for printing one pixel. As the signal potential of the restored latching signal rLAT changes to a different level, the restored printing data signal rSI held at a shift register portion 81 having the head unit 70 is latched. The restored latching signal rLAT becomes a high level in accordance with the start timing of the cycle of the driving signal COM. The restored channel signal rCH shown in FIG. 3(C1) is a signal for defining the output timing of each wave portion constituting the driving signal. The restored channel signal rCH becomes a high level in accordance with the start timing of the second and subsequent wave portions (P2). The timing when the restored latching signal rLAT (FIG. 3(B1)) and the restored channel signal rCH (FIG. 3(C1)) become a high level is the timing when the driving signal COM as shown in FIG. 3(A) is held at a steady potential Vst. The restored latching signal rLAT and the original latching signal sLAT have the same signal waves and are signals having different timing for when the signal potential changes. The restored channel signal rCH also has the same signal wave as the original channel signal sCH and is a signal having a different timing for when the signal potential changes. The other restored control signals and the original control signals have similar relationships.

In FIG. 3(B2), an original latching signal sLAT is shown. In FIG. 3(C2), an original channel signal sCH is shown. In the restored latching signal rLAT and the restored channel signal rCH of this embodiment, in comparison to the original latching signal sLAT and the original channel signal sCH, there is a delay (latency LTC) in the timing where the voltage changes and reaches a high level for the time needed to convert to a serial form and a time needed to be serialized. However, the timing when the restored latching signal rLAT becomes a high level is the timing when the driving signal COM shown in FIG. 3(A) is held at a steady potential Vst, similar to the original latching signal sLAT. Similarly, the timing when the restored channel signal rCH of this embodiment becomes a high level is the timing when the driving signal COM shown in FIG. 3(A) is held at a steady potential Vst, similar to the original channel signal sCH. That is, the driving signal COM is held at a steady potential Vst for the latency LTC before the restored latching signal rLAT and the restored channel signal rCH are input to the nozzle unit 80. Therefore, even when there is a latency LTC for the restored latching signal rLAT and the restored channel signal rCH, the timing when the restored latching signal rLAT and the channel signal rCH become a high level does not overlap with the rising portion and the falling portion of the wave of the driving signal COM. The original latching signal sLAT can be considered to be a latching signal for when there is no conversion into a serial form or deserialization. The original channel signal sCH can be considered to be a channel signal for when there is no conversion into a serial form or deserialization.

The restored printing data signal rSI as shown in FIG. 3(D) is a signal showing the dot size of each pixel and the existence or nonexistence of dots. The clock signal LVDS_CLK for LVDS shown in FIG. 3(E) is a signal for obtaining the timings of each data and signals and transmitting them to the line head unit 70 using the LVDS transfer method. The restored data enable signal rDE shown in FIG. 3(F) is a signal for creating the clock signal rSI_CLK shown in FIG. 3(G). In this embodiment, the clock signal rSI_CLK is created by dividing the clock signal LVDS_CLK for LVDS when the restored data enable signal rDE is at a high level. In addition, although it is not shown in FIG. 3, a latency LTC due to conversion into a serial form and deserialization exists for the restored printing data signal rSI and the restored data enable signal rDE, etc., just as it exists for the restored latching signal rLAT and the restored channel signal rCH.

Retuning to FIG. 2, the nozzle unit 80 is provided with a shift register portion 81, a latching portion 82, a level shifter portion 83, and a selecting switch portion 84. The restored printing data signal rSI is input to and held at the shift register portion 81. Then, according to the clock signal rSI_CLK, the position where the restored printing data signal rSI is recorded in the shift register portion 81 sequentially shifts to a subsequent step. The latching portion 82 sequentially latches the output signal of the shift register portion 81 at the timing where the restored latching signal rLAT and the restored channel signal rCH becomes a high level. The signal latched at the latching portion 82 is converted to a voltage level at which the selecting switch portion 84 it turned on or off by the level shifter portion 83. The output signal of the level shifter portion 83 is supplied to a control terminal (not illustrated) of a corresponding selecting switch portion 84 and turn individual selecting switch portions 84 on or off. From the selecting switch portions 84 in an ON state, the driving signal COM determined by the restored printing data signal rSI input to the shift register portion 81 is supplied to the piezoelectric elements connected to the selecting switch. On the other hand, from the selecting switch portion 84 in an OFF state, the driving signal COM is not supplied to the piezoelectric elements connected to the selecting switch portion 84. In this way, the driving signal COM is supplied to the piezoelectric element, thereby ejecting the ink from the nozzle and forming dots on the print medium RM.

In addition, although it is not shown in FIG. 2 and FIG. 3, in this embodiment, the N-charge signal sNCHG is created at the control signal generating portion 21 of the control unit 20, serialized together with plural types of original control signals such as the original latching signals sLAT and transmitted to the line head unit 70. The N-charge signal sNCHG is a signal used for flashing a printer 100, for example. The restored N-charge signal rNCHG supplies the driving signal COM to all piezoelectric elements regardless of the restored printing data signal rSI.

As explained above, in the printer 100 of this embodiment, the plural types of original control signals created in the control signal generating portion 21 are converted into a single serial form serial control signal by the signal converting portion 22. Therefore, the serial control signal is transmitted to the head unit 70 only by the signal line 41. Therefore, in the line head printer, even when control signals increase with the increase in the number of nozzles and nozzle units, the increase of wirings (signal lines) can be controlled to simplify the structure of the device. Also, the driving signal COM is transmitted to the nozzle unit 80 in an analog form without being converted into a serial form. Therefore, the driving signal COM transmitted to the nozzle unit 80 does not have deformation of the wave due to serialization. Therefore, since an unintended ink ejection due to the deformation of the wave of the driving signal COM is prevented, the liquid is stably ejected from the nozzle. Also, since there is no delay for the driving signal COM due to the conversion to a serial form, the liquid is ejected from the nozzle at intended timings. Furthermore, since the driving signal COM is transmitted to the head unit 70 in an analog form, it is not required to create a driving signal COM considering the delay due to the conversion into a serial form in the control unit 20. Therefore, the process for the control unit 50 of the printer 100 can be simplified. Therefore, at least one of the control of the increase of wirings (signal lines), the simplification of the structure of the device, the simplification of the process of the control unit 20, the stabilization of the ejection of ink of the printer 100, and the adjustment of the timing of ejecting liquid can be achieved.

In order to convert the driving signal COM into a serial form and adjust the timing to eject the liquid appropriately, a timing data for cancelling the delay due to the conversion of the driving signal COM into a serial form on the head unit 70 side is transmitted. Also, it can be conceived that a circuit for creating a driving signal COM in which delay is cancelled based on the timing data is provided on the head unit 70. However, if such a circuit is provided, the structure of the head unit 70 becomes large. In the printer 100 of this embodiment, the driving signal COM is transmitted to the head unit 70 in an analog form, thereby preventing the structure of the head unit 70 from becoming large.

Further, the front potential of the driving signal COM is held at a steady potential Vst. The period in which the front potential is held at a steady potential is more than the total of the period needed for the signal converting portion 22 to convert the plural types of the original control signals into a serial form serial control signal and the period needed for the signal restoring portion 71 to convert the serial control signal into a parallel form to create the restored control signal. That is, the period when the steady potential Vst is held is more than the period of latency. Therefore, even when the timing when the restored latching signal rLAT and the restored channel signal rCH become a high level is delayed due to the conversion and restoring in comparison to the original latching signal sLAT and the original channel signal sCH, the driving signal COM is held at a steady potential for a period that is more than the period of the delay. Therefore, the restored latching signal rLAT and the restored channel signal rCH can be prevented from reaching a high level at the rising portion and the falling portion of the wave of the driving signal COM. Also, since the timing when the nozzle ejects the liquid is adjusted based on the restored control signals converted to a parallel form, the liquid can be prevented from being ejected from the nozzle at unintended timings.

The driving signal COM is created at the side of the control unit 20 of the printer 100, not at the side of the head unit 70. The COM creating portion 23 creates a driving signal COM having a comparatively high voltage. Therefore, the signal created by the circuit arranged in the vicinity of the COM creating portion 23 may create noise due to the creation of the driving signal COM. However, on the control unit 20 side of the printer 100, since the level of flexibility of design is comparatively higher unlike the head unit 70 side where the ink is actually ejected, a space can be secured to provide a countermeasure for noise in the vicinity of the COM transmitting portion 24 and a member can be provided. Therefore, the printer 100 of this embodiment is capable of making the structure of the head unit 70 small while providing sufficient countermeasure for noise.

Also, by creating the clock signal SI_CLK at the control signal generating portion 21 of the control unit 20 and providing another line for the clock signal SI_CLK different from the signal line 41, it can be transmitted to the head unit 70. However, in this embodiment, in the rSI_CLK generating portion 72, the clock signal rSI_CLK is created by dividing the clock signal LVDS_CLK for LVDS when the restored data enable signal rDE is at a high level. Therefore, the wiring between the control unit 20 and the head unit 70 can be simplified. Also, the timing between the clock signal sSI_CLK and the driving signal COM not accompanying the change to a serial form and the restored latching signal rLAT and the restored printing data signal rSI accompanying the change to a serial form does not need to be separately adjusted when the clock signal SI_CLK is created on the control unit 20 side. Therefore, the design of the printer 100 can be prevented from being complex.

B. Modified Embodiments

The aforementioned embodiment can be modified variously as described below.

MODIFIED EXAMPLE 1

In this embodiment, in the driving signal COM, the front potential is held at a steady potential Vst for a period or period more than the combined period of the period needed to convert the original control signal to a serial form and the period needed to convert it into a parallel form to create the restored control signal. On the other hand, the driving signal COM can be held at a steady potential Vst at an end potential, not at the front potential, for a period or more than a period needed for these conversions. That is, the driving signal COM can be held at a steady potential Vst for a predetermined period after the restored latching signal rLAT is input to the nozzle unit 80.

Modified Embodiment 2

In the aforementioned embodiment, the driving signal COM transmitting portion 24 of the control unit 20 transmits the driving signal COM held at a steady potential Vst at a front potential for a period or more than a combined period of a period needed to serialize the control signal and a period needed for deserialization. In this way, the ink is prevented from being ejected from the nozzle at unintended timings. On the other hand, the control signal generating portion 21 can create an original control signal defining a timing in which the voltage changes to a different level according to a period for converting the original control signal to a serial control signal. For example, the control signal generating portion 21 can transmit the original control signal in which the timing of reaching a high level has shifted (early) for the amount of the period needed for the serialization and the deserialization of the original control signal. In this way, when the restored control signal restored by the signal restoring portion 71 controls the timing of the liquid being ejected from the nozzle, the delay due to the conversion into a serial form at the restored control signal will be cancelled. Even in this way, for a period in which the driving signal COM is held at a steady potential Vst, the restored latching signal rLAT and the restored channel signal rCH become a high level. Therefore, the liquid can be prevented from being ejected from the nozzle at unintended timings.

Modified Embodiment 3

In this embodiment, the printer 100 is a line head type printer. On the other hand, the present invention can be applied to a serial scanning type printer in which a print head having a nozzle performs printing while moving in a main scanning direction.

The present invention is not limited to the aforementioned embodiments and modified examples and can be actualized by various structures unless it deviates from the spirits of the invention. For example, the technical characteristics of the embodiments and modified examples corresponding to the technical characteristics in each embodiment as described in the summary of the invention can be arbitrarily switched or combined to solve a part or all of the aforementioned problems or to achieve a part or all of the aforementioned effects. Also, the technical characteristics can be arbitrarily eliminated if they are not explained to be required be essential in this specification.

(1) According to one aspect of the embodiment, a liquid ejection device includes a head unit and a control unit. The head unit includes a plurality of nozzle units each having a plurality of nozzles configured and arranged to eject liquid. The control unit is configured to control ejection of the liquid. The control unit includes a driving signal generating portion, a control signal generating portion, a signal converting portion, a driving signal transmitting portion, and a control signal transmitting portion. The driving signal generating portion is configured to create a driving signal having at least one wave portion for ejecting the liquid from the nozzles. The control signal generating portion is configured to create plural types of original control signals including an original latching signal for controlling a timing of the ejection of the liquid from the nozzles and an original printing data signal for controlling ejection or non-ejection of the liquid. The signal converting portion is configured to convert the plural types of the original control signals into a single serial control signal having a serial form. The driving signal transmitting portion is configured to transmit the driving signal to the head unit in an analog form. The control signal transmitting portion is configured to transmit the serial control signal to the head unit in the serial form. The head unit includes a driving signal receiving portion, a control signal receiving portion, and a signal restoring portion. The driving signal receiving portion is configured to receive the driving signal from the control unit. The control signal receiving portion is configured to receive the serial control signal from the control unit. The signal restoring portion is configured to create plural types of restored control signals to be input to the nozzle units from the serial control signal received, the restored control signals including a restored latching signal for controlling the timing of the ejection of the liquid from the nozzles and a restored printing data signal for controlling ejection or non-ejection of the liquid. The nozzles are configured and arranged to eject the liquid based on the driving signal, the restored latching signal, and the restored printing data signal. According to the liquid ejection device of this embodiment, a single serial form serial control signal is created from plural types of original control signals, which in turn is transmitted to the head unit. Therefore, the increase of wirings (signal lines) of the liquid ejection device can be controlled, thereby making it possible to simplify the structure of the device. Also, the driving signal is transmitted to the head unit in an analog form. Therefore, since the wave of the driving signal will not be disturbed due to the conversion into a serial form, an intended amount of liquid will be stably ejected from the nozzle. Further, since there is no delay for the driving signal due to the conversion into a serial form, the liquid is ejected from the nozzle at intended timings. Further, since it is not required to provide a circuit for creating, e.g., a driving signal on the head unit, the head unit can be made small.

(2) In the liquid ejection device of the aforementioned aspect, the driving signal can be held at a predetermined potential for a predetermined period before inputting the restored latching signal to the nozzle unit, or a predetermined period after inputting the restored latching signal to the nozzle unit. According to the liquid ejection device of this aspect, even when there is a delay in the restored latching signal in comparison to the original latching signal, the driving signal is held at a predetermined potential for the period of the delay. Therefore, the liquid can be prevented from being ejected from the nozzle at unintended timings.

(3) In the liquid ejection device of the aforementioned aspect, the timing that the potential of the original latching signal changes and the timing that the potential of the restored latching signal changes can be different. According to the liquid ejection device of this aspect, a restored latching signal different in timing of changing a signal potential from the original latching signal can be input to the nozzle unit.

(4) In the liquid ejection device of the aforementioned aspect, the control signal generating portion can create the original latching signal defining a timing that a potential changes depending on a period for converting the plural types of original control signals into the serial control signal by the signal creating portion and a period for creating the plural types of restored control signal from the series control signal by the signal restoring portion. According to the liquid ejection device of this aspect, for the original latching signal, the timing that a potential changes depending on a period for converting into the serial form and creating the restored latching signal is defined, when controlling the timing to eject liquid from the nozzle, the delay due to the conversion into a serial form and the creation of the restored latching signal is cancelled. Therefore, the liquid can be prevented from being ejected from the nozzle at unintended timings.

(5) In the liquid ejection device of the aforementioned aspect, the plural types of original control signals can include an original channel signal defining an output timing of each wave portion constituting the driving signal by changing of a signal potential into different levels, and the plural types of restored control signals can include a restored channel signal defining an output timing of each wave portion constituting the driving signal by changing of a signal potential into different levels. According to the liquid ejection device of this aspect, the plural types of original control signals including the original channel signal are converted into a single serial form serial control signal and transmitted to the head unit. Also, the restored channel signal is created from the serial control signal. Therefore, the timing to eject liquid from the nozzle is determined based on the signal synchronized with the driving signal.

Not all of the plurality of structural components of each of the aforementioned aspects of the embodiment is required. To solve a part or all of the aforementioned problems, or to achieve a part or all of the effects described in this specification, parts of the structural element among the plurality of structural elements can be changed, eliminated, switched with other new structural element, and a limited content thereof can be partially eliminated. Also, to solve a part or all of the aforementioned problems, or to achieve a part or all of the effects described in this specification, a part or all of the technical characteristics included in the aspect of the embodiment can be combined with a part or all of the technical characteristics included in other aspects of the embodiment to form an independent embodiment of the embodiment.

For example, an aspect of the embodiment can be actualized as a device including one or more elements among a driving signal generating portion, a control signal generating portion, a signal converting portion, a driving signal transmitting portion, a control signal transmitting portion, a driving signal receiving portion, a control signal receiving portion, and a signal restoring portion. That is, the device can include a driving signal generating portion, but not required. Also, the device can include a control signal generating portion, but not required. Further, a signal converting portion can be included, but not required. Furthermore, a driving signal transmitting portion can be included, but not required. Also, a control signal transmitting portion can be included, but not required. Also, a driving signal receiving portion can be included, but not required. Further, a control signal receiving portion can be included, but not require. Also, a signal restoring portion can be included, but not required. The device can be actualized as a liquid ejection device, for example, and also can be actualized as another product other than a liquid ejection device. According to these aspects, at least one of various problems such as miniaturization of the product, cost reduction, resource-saving, simplification of production, improvement of usability, etc., can be solved. A part or all of the technical characteristics of the liquid ejection device can be applied to this product.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A driving device for driving a piezoelectric element comprising:

a piezoelectric unit including the piezoelectric element; and a control unit configured to control the piezoelectric unit, the control unit including a driving signal generating portion configured to create a driving signal having at least one wave portion for driving the piezoelectric element, a control signal generating portion configured to create plural types of original control signals including an original data signal for controlling supply or non-supply of the driving signal to the piezoelectric element, a signal converting portion configured to convert the plural types of the original control signals into a single serial control signal having a serial form, a driving signal transmitting portion configured to transmit the driving signal to the piezoelectric unit in an analog form via a first signal line, and a control signal transmitting portion configured to transmit the serial control signal to the piezoelectric unit in the serial form via a second signal line different from the first signal line, the piezoelectric unit including a driving signal receiving portion configured to receive the driving signal from the control unit via the first signal line, a control signal receiving portion configured to receive the serial control signal from the control unit via the second signal line, and a signal restoring portion configured to create plural types of restored control signals by restoring the serial control signal, the restored control signals including a restored data signal, the restored control signals and the restored data signal corresponding to the original control signals and the original data signal, respectively, and the piezoelectric unit being configured to drive the piezoelectric element based on the driving signal and the restored data signal.

2. The driving device for driving the piezoelectric element according to claim 1, wherein the plural types of the original control signals further include an original latching signal for controlling a timing of the supply of the driving signal to the piezoelectric element, and the plural types of the restored control signals further include a restored latching signal that corresponds to the original latching signal.

3. The driving device for driving the piezoelectric element according to claim 2, wherein the driving signal is held at a predetermined potential for a predetermined period before inputting the restored latching signal to the piezoelectric unit or a predetermined period after inputting the restored latching signal to the piezoelectric unit.

4. The driving device for driving the piezoelectric element according to claim 2, wherein a timing that a potential of the original latching signal changes and a timing that a potential of the restored latching signal changes are different.

5. The driving device for driving the piezoelectric element according to claim 2, wherein the control signal generating portion is configured to create the original latching signal defining a timing that a potential changes, depending on a period for converting the plural types of the original control signals into the serial control signal by the signal converting portion and a period for creating the plural types of the restored control signals from the serial control signal by the signal restoring portion.

6. The driving device for driving the piezoelectric element according to claim 1, wherein the plural types of the original control signals further include an original channel signal defining an output timing of each wave portion constituting the driving signal by changing of a signal potential into different levels, and the plural types of the restored control signals further include a restored channel signal that corresponds to the original channel signal and defines the output timing of the each wave portion.

7. A control unit configured to control a piezoelectric unit that includes a piezoelectric element, receives a signal having a serial form, and drives the piezoelectric element based on signals created by restoring the signal having the serial form, the control unit comprising:

a driving signal generating portion configured to create a driving signal having at least one wave portion for driving the piezoelectric element;

a control signal generating portion configured to create plural types of original control signals including an original data signal for controlling supply or non-supply of the driving signal to the piezoelectric element;

a signal converting portion configured to convert the plural types of the original control signals into the signal having the serial form;

a driving signal transmitting portion configured to transmit the driving signal to the piezoelectric unit in an analog form via a first signal line; and a control signal transmitting portion configured to transmit the signal having the serial form to the piezoelectric unit in the serial form via a second signal line different from the first signal line.

8. A piezoelectric unit configured to be controlled based on a signal having a serial form that is transmitted from a control unit, the piezoelectric unit comprising:

a piezoelectric element;

a driving signal receiving portion configured to receive a driving signal that has at least one wave portion for driving the piezoelectric element and is transmitted in an analog form from the control unit via a first signal line;

a control signal receiving portion configured to receive the signal having the serial form into which plural types of original control signals are converted and that is transmitted in the serial form from the control unit via a second signal line different from the first signal line, the plural types of the original control signals including an original data signal for controlling supply or non-supply of the driving signal to the piezoelectric element; and a signal restoring portion configured to create plural types of restored control signals by restoring the signal having the serial form, the restored control signals including a restored data signal, the restored control signals and the restored data signal corresponding to the original control signals and the original data signal, respectively, the piezoelectric unit being configured to drive the piezoelectric element based on the driving signal and the restored data signal.

* * * * *